US009309676B1

(12) United States Patent
Szalacinski

(10) Patent No.: US 9,309,676 B1
(45) Date of Patent: Apr. 12, 2016

(54) PRE-FINISHED INSULATED BUILDING PANEL

(71) Applicant: Brad W. Szalacinski, Lisbon, WI (US)

(72) Inventor: Brad W. Szalacinski, Lisbon, WI (US)

( * ) Notice: Subject to any disclaimer, the term of this patent is extended or adjusted under 35 U.S.C. 154(b) by 0 days.

(21) Appl. No.: 14/635,247

(22) Filed: Mar. 2, 2015

Related U.S. Application Data

(60) Provisional application No. 62/047,243, filed on Sep. 8, 2014.

(51) Int. Cl.

| | |
|---|---|
| ***E04B 1/38*** | (2006.01) |
| ***E04C 1/40*** | (2006.01) |
| ***E04F 13/00*** | (2006.01) |
| ***E04B 1/62*** | (2006.01) |
| ***E04B 2/00*** | (2006.01) |
| ***E04C 2/52*** | (2006.01) |
| ***E04B 1/76*** | (2006.01) |
| ***E04F 13/077*** | (2006.01) |

(52) U.S. Cl.

CPC ..... *E04F 13/007* (2013.01); *E04B 1/625* (2013.01); *E04B 1/7645* (2013.01); *E04C 2/46* (2013.01); *E04C 2/523* (2013.01); *E04F 13/077* (2013.01); *E04F 2290/04* (2013.01)

(58) Field of Classification Search

CPC ... E04F 13/007; E04F 13/077; E04F 2290/04; E04B 1/7645; E04B 7/625; E04C 2/46; E04C 2/523

USPC ..... 52/169.5, 169.14, 510, 511, 506.05, 52/309.5

See application file for complete search history.

(56) References Cited

U.S. PATENT DOCUMENTS 5,826,388 A * 10/1998 Irving ..... E04B 1/7612 52/267
6,745,531 B1 * 6/2004 Egan ..... E04B 1/70 52/302.1
8,636,941 B1 * 1/2014 Ciuperca ..... E01C 11/18 106/707
9,016,020 B1 * 4/2015 Yang ..... E04F 13/0803 52/511
2007/0199266 A1 * 8/2007 Geilen ..... E04B 2/8629 52/309.12
2011/0258944 A1 * 10/2011 Radoane ..... E04B 2/58 52/62
2013/0074433 A1 * 3/2013 Ciuperca ..... E04B 1/355 52/426
2013/0122769 A1 * 5/2013 Brabbs ..... E04F 13/077 442/286
2014/0123584 A1 * 5/2014 Krapf ..... B43L 1/00 52/483.1
2014/0333010 A1 * 11/2014 Ciuperca ..... B28B 7/34 264/338
2015/0267404 A1 * 9/2015 Yau ..... E04C 2/523 52/794.1
2015/0308104 A1 * 10/2015 Lasselsberger ..... E04B 1/7645 52/302.3

* cited by examiner

*Primary Examiner* — Brian Glessner
*Assistant Examiner* — Paola Agudelo
(74) *Attorney, Agent, or Firm* — Donald J. Ersler

(57) ABSTRACT

A pre-finished insulated panel building system preferably includes a base member, a cover member and a decorative coating. A moisture barrier sheet is preferably attached to an exterior surface of a building. A drainage and ventilation mat is attached to the moisture barrier or directly to the exterior surface of the building. The base member is preferably a rectangular block, which is attached to an interior or exterior surface of the building. The cover member includes a base cavity formed in a bottom thereof. A perimeter of the base cavity is sized to receive an outer perimeter and height of the base member. Alternatively, the cover member is secured to the base member with a pair of snap rails. Each snap rail includes a base rail member and a cover rail member. The top and outer perimeter of the cover member is sprayed with the decorative coating.

16 Claims, 9 Drawing Sheets

PRE-FINISHED INSULATED BUILDING PANEL

CROSS-REFERENCES TO RELATED APPLICATIONS

This is a utility patent application taking priority from provisional application No. 62/047,243 filed on Sep. 8, 2014.

BACKGROUND OF THE INVENTION

1. Field of the Invention

The present invention relates generally to buildings and more specifically to a pre-finished insulated panel building system, which is quickly installed on an exterior of a building or to an interior of a building.

2. Discussion of the Prior Art

Patent application no. 2011/0258944 to Radoane discloses a NP-EIFS non-permissive exterior insulation and finish systems concept technology and details.

Accordingly, there is a clearly felt need in the art for a pre-finished insulated panel building system, which provides an increased insulation value to a building; is quickly installed to the exterior building surface; is quickly installed to an interior building surface; may be manufactured at a remote site, instead of on site; and has an inexpensive, attractive finish.

SUMMARY OF THE INVENTION

The present invention provides a pre-finished insulated panel building system, which provides an increased insulation value to a building. The pre-finished insulated panel building system (panel building system) preferably includes a base member, a cover member and a decorative coating. A moisture barrier sheet is preferably attached to an exterior surface of a building, if the exterior surface absorbs moisture. A drainage and ventilation mat is attached to the building, over the moisture barrier sheet, or directly to an exterior of the building. However, if applying the panel building system to an interior of a building, the moisture barrier sheet, and the drainage and ventilation mat is not used. The base member is preferably a rectangular block, which is attached to the exterior of the building. However, other suitable shapes besides a rectangle may also be used. The base member is preferably fabricated from an EPS or XPS Styrofoam, but other materials may also be used.

The drainage and ventilation mat may be pre-attached to the base member. The cover member includes a base cavity formed in a bottom thereof. A perimeter of the base cavity is sized to receive an outer perimeter and height of the base member. The cover member is preferably fabricated from an EPS or XPS Styrofoam, but other materials may also be used. Alternatively, the cover member is secured to the base member with a pair of snap rails. Each snap rail includes a base rail member and a cover rail member. The base rail member is attached to opposing sides of the base member. The cover rail member is attached to a bottom of the base cavity and near opposing sides thereof of the cover member. A mesh sheet is preferably applied to an exterior surface of the cover member and a coating is applied to mesh sheet.

The top and outer perimeter of the cover member is then sprayed with the decorative coating. The decorative coating may be an acrylic coating, a polymer modified cement coating, urethane, stucco, epoxy, polyaspartec (with a polymer modified cement base coat), or any suitable coating. The decorative coating may have the appearance of precast concrete, granite, brick, field stone, marble, stone or any other suitable substance. A gap between adjacent panel building systems is preferably filled with a backer rod. The backer rod is packed into the gap with any suitable tool. The gap is then caulked to seal the gap.

Accordingly, it is an object of the present invention to provide a panel building system, which provides an increased insulation value to a building.

It is another object of the present invention to provide a panel building system, which is quickly installed to an exterior or interior building surface.

It is a further object of the present invention to provide a panel building system, which may be manufactured at a remote site, instead of on site.

Finally, it is another object of the present invention to provide a panel building system, which has an inexpensive, attractive finish.

These and additional objects, advantages, features and benefits of the present invention will become apparent from the following specification.

DETAILED DESCRIPTION OF THE PREFERRED EMBODIMENTS

Figure 1:
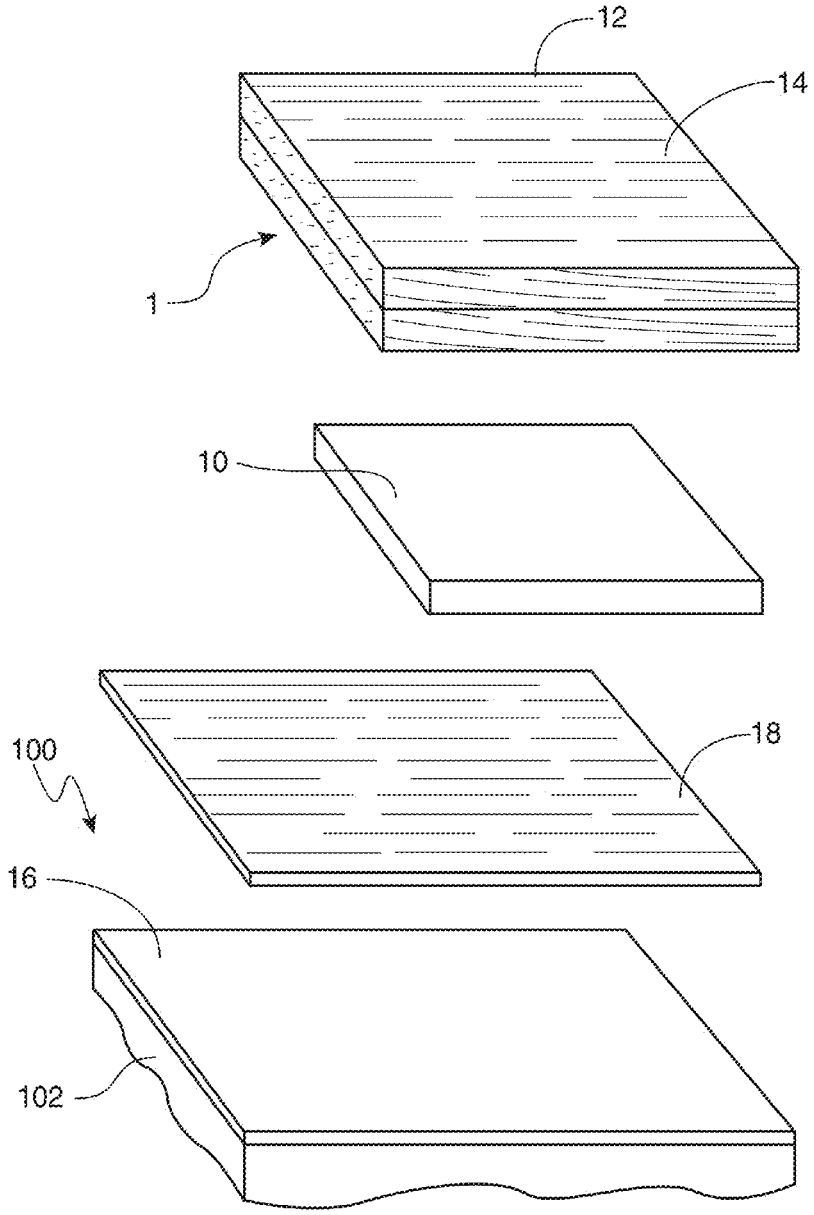
FIG. 1 is an exploded perspective view of a panel building system in accordance with the present invention.
Figure 2:
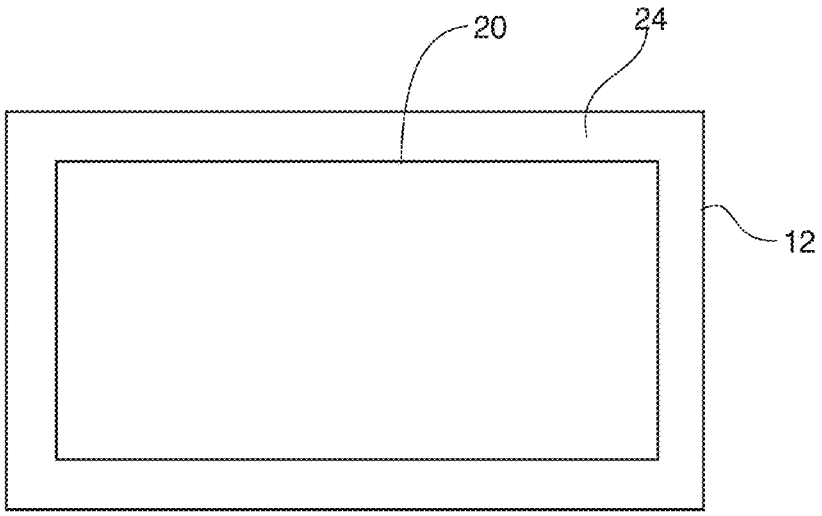
FIG. 2 is a bottom view of a cover member of a panel building system in accordance with the present invention.
Figure 4:
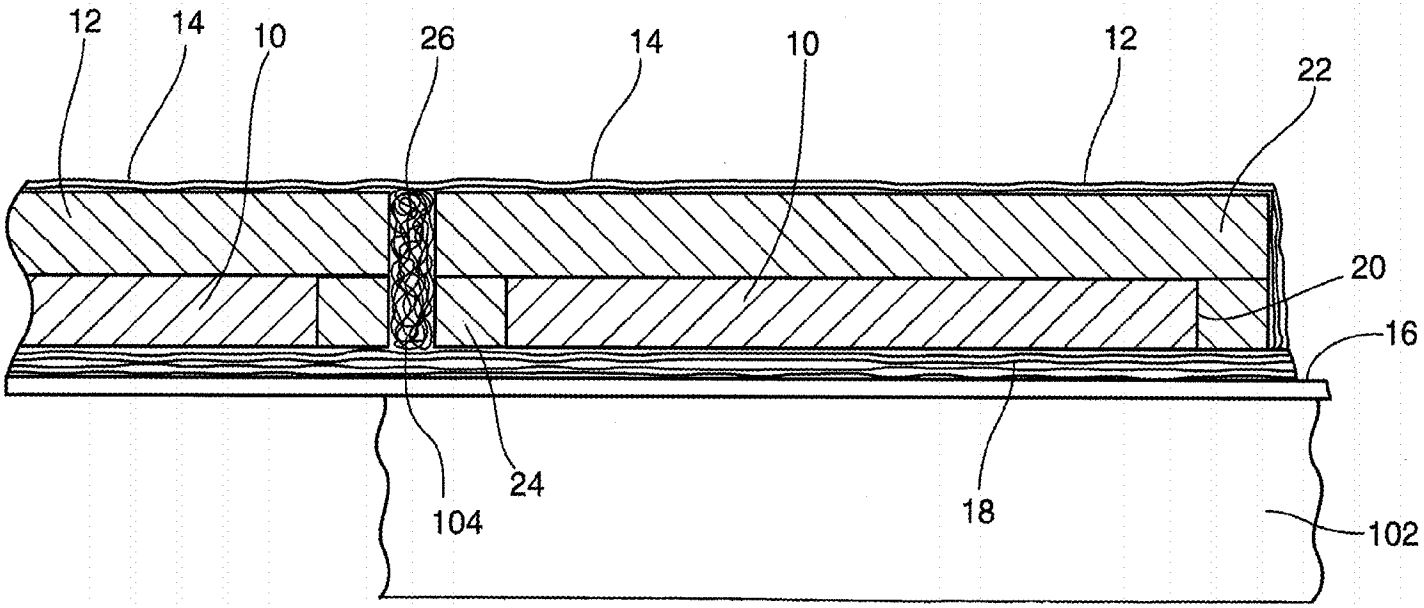
FIG. 4 is a cross sectional view of two adjacent panel building systems in accordance with the present invention.

With reference now to the drawings, and particularly to FIG. 1, there is shown an exploded perspective view of a panel building system 1. With reference to FIGS. 2 and 4, the panel building system 1 preferably includes a base member 10, a cover member 12 and a decorative coating 14. A moisture barrier sheet 16 is preferably attached to an exterior surface 102 of a building 100, if the exterior surface 102 absorbs moisture. The moisture barrier sheet 16 is preferably attached to the exterior surface 102 with fasteners, such as nails or staples. The moisture barrier sheet 16 may be DuPont Tyvek, tar paper or any other suitable moisture barrier. A drainage and ventilation mat 18 is placed on top of the moisture barrier sheet 16 and attached to the exterior surface 102, or attached directly to the exterior surface 102 of the building 100. The drainage and ventilation mat 18 is preferably attached to the exterior surface with fasteners, such as nails or staples. The drainage and ventilation mat 18 may be purchased from Keene Building Products, under the product name of "Dri-wall Rainscreen."

Figure 3:
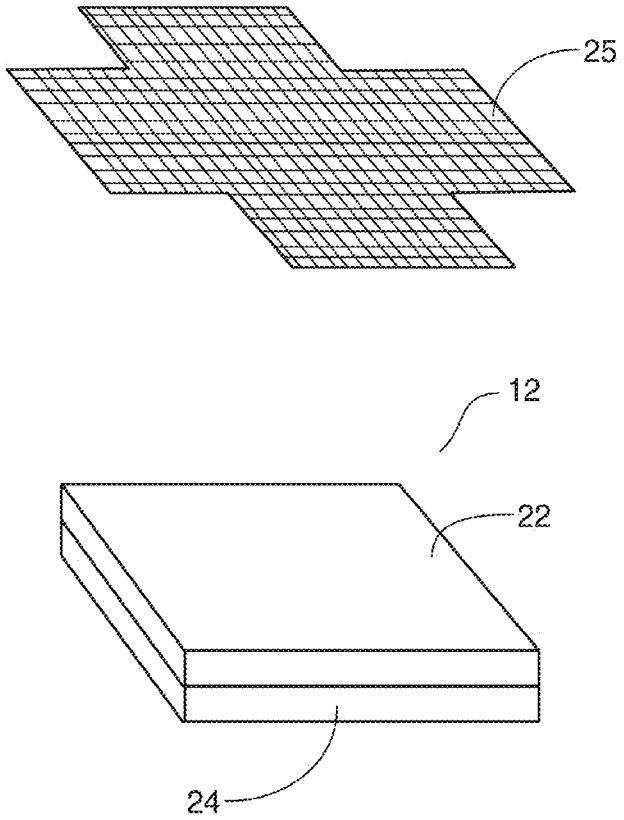
FIG. 3 is an exploded perspective view of a mesh sheet, before attachment to a cover member of a panel building systems in accordance with the present invention.

The base member 10 preferably has the shape of a rectangular block or any other suitable shape. However, other suitable shapes besides a rectangle may also be used. The base member 10 is placed over the drainage and ventilation mat 18 and preferably attached to the exterior surface 102 with fasteners, such as nails or staples. However, the drainage and ventilation mat 18 may be pre-attached to the base member 10. If the panel building system 1 is attached to an interior surface of a building, the base member 10 is attached directly to the interior surface. The base member 10 is preferably fabricated from an EPS or XPS Styrofoam, but other materials may also be used. With reference to FIG. 3, the cover member 12 includes a base cavity 20 formed in a bottom thereof. A perimeter and depth of the base cavity 20 is sized to receive an outer perimeter and height of the base member 10. The cover member 12 preferably includes a top portion 22 and a cavity portion 24. A perimeter of the base cavity 20 is formed in the cavity portion 24. The cavity portion 24 is then attached to a bottom of the top portion 22. The base member 10 is preferably taken from the material used to create the cavity portion 24. The top portion 22 and cavity portion 24 are preferably fabricated from an EPS or XPS Styrofoam, but other materials may also be used. With reference to FIG. 3, it is preferable to wrap an outer perimeter of the cover member 12 with a mesh sheet 25. A coating is applied to the mesh sheet 25 to attach the mesh sheet 25 on the cover member 12. The mesh sheet 25 and coating increase the strength of the cover member 12. The mesh sheet 25 is preferably fabricated from nylon mesh. The coating is preferably acrylic, but other suitable coatings may also be used.

A top of the base member 10 is preferably secured to a bottom of the base cavity 20 or to a bottom of the top portion 22 with adhesive or any suitable attachment method or system. The top and outer perimeter of the cover member 12 or the top portion 22 and the cavity portion 24 are sprayed with the decorative coating 14. The decorative coating 14 may be an acrylic coating, a polymer modified cement coating, urethane, stucco, epoxy, polyaspartec (with a polymer modified cement base coat), or any suitable coating. The decorative coating 14 may have the appearance of precast concrete, granite, brick, field stone, marble, stone or any other suitable substance.

Figure 6:
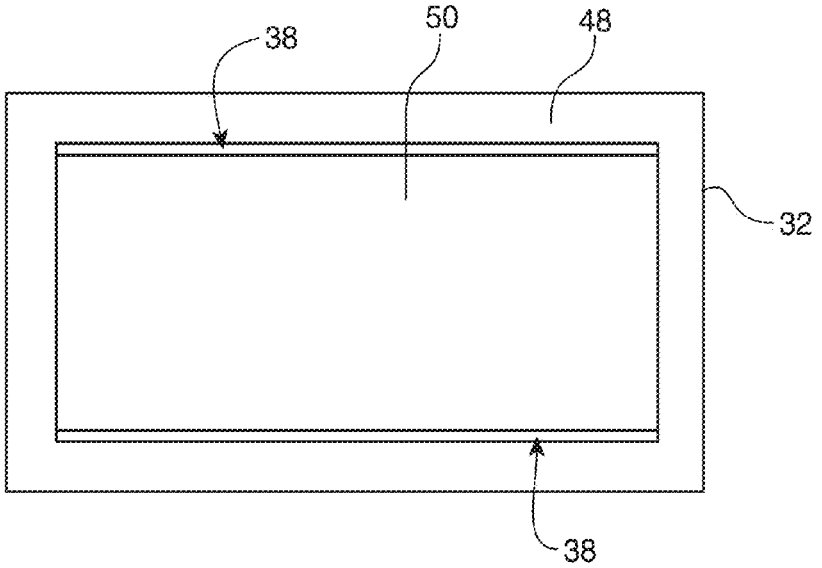
FIG. 6 is a bottom view of an end cover member of a panel building system having an alternative attachment method in accordance with the present invention.
Figure 5:
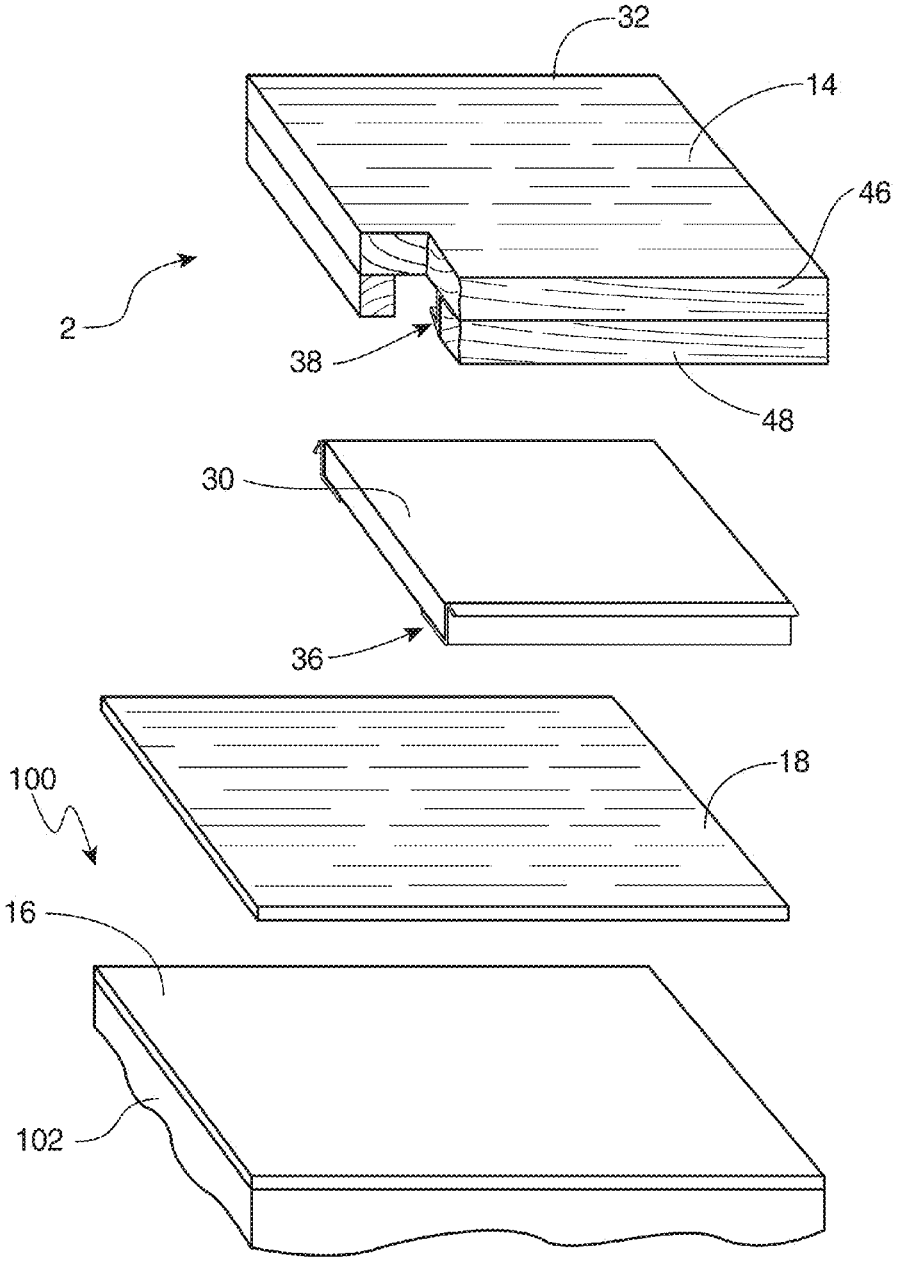
FIG. 5 is an exploded perspective view of a panel building system having an alternative attachment method in accordance with the present invention.
Figure 8:
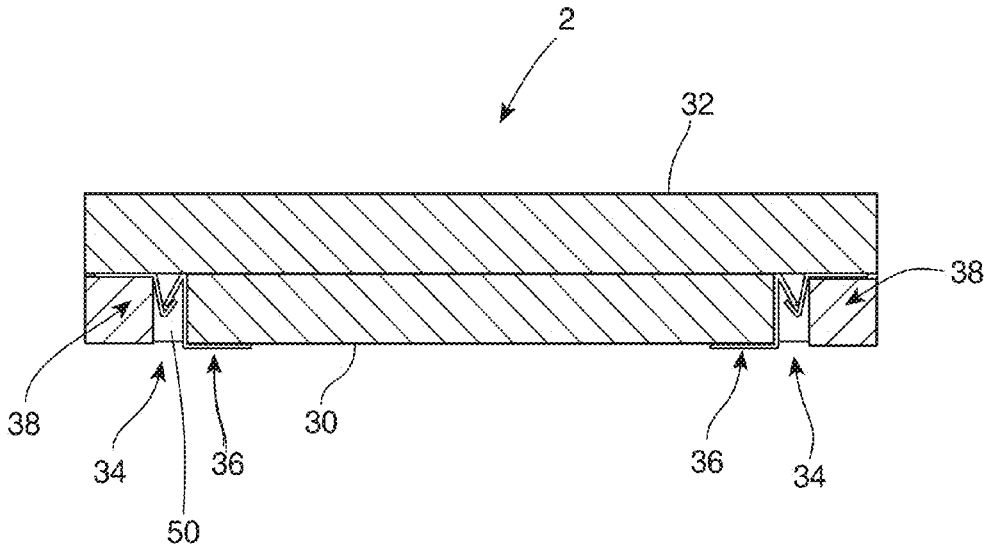
FIG. 8 is a cross sectional view of a cover member of a panel building system having an alternative attachment method in accordance with the present invention.
Figure 9:
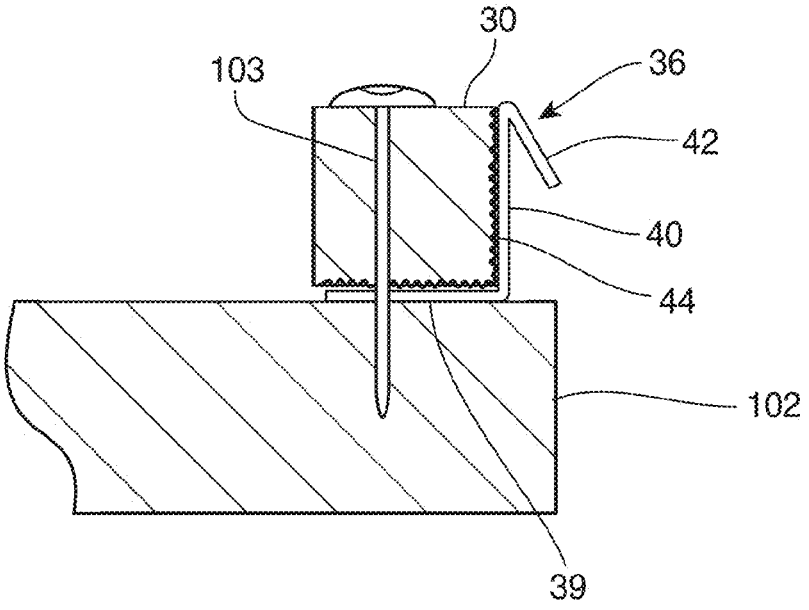
FIG. 9 is a cross sectional view of a base rail member of a panel building system having an alternative attachment method in accordance with the present invention.
Figure 10:
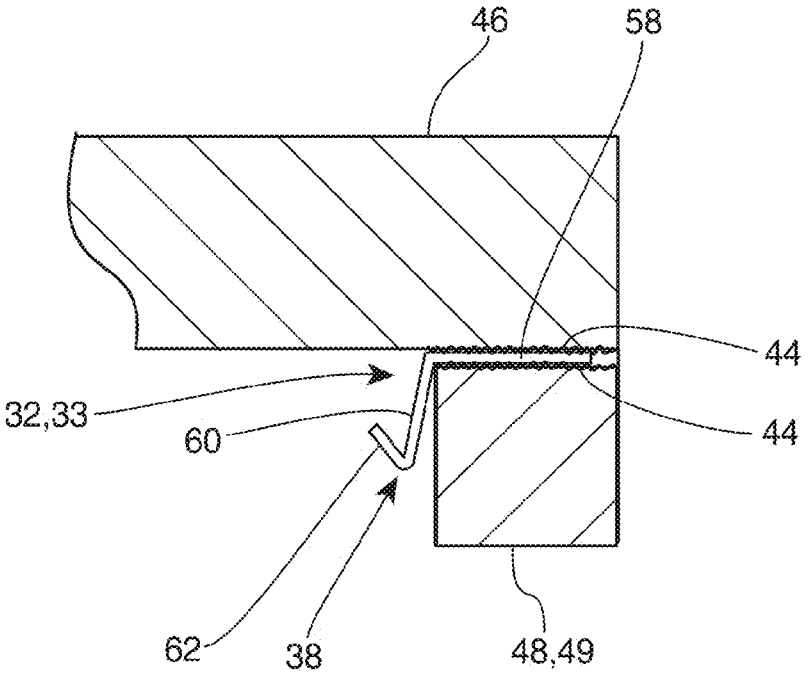
FIG. 10 is an end view of a cover rail member of a panel building system having an alternative attachment method in accordance with the present invention.

With reference to FIGS. 5, 6 and 8, disclose a panel building system with an alternative securement system (panel building system system) 2 for attaching a cover member 32 to a base member 30. The building panel system 2 includes a pair of snap rails 34. Each snap rail 34 includes a base rail member 36 and a cover rail member 38. With reference to FIGS. 9-10, the base rail member 36 includes a base flange 39, a base upright portion 40 and a base clip 42. The base upright portion 40 extends from an edge of the base flange 39 and a distal end of the base upright portion 40 is terminated with the base clip 42. A top of the base flange 39 is preferably attached to a bottom of the base member 30 with adhesive 44 or the like. The two base rail members 36 are attached to opposing sides of the base member 30. The base member 30 is attached to the exterior surface 102 with a fastener 103 or the like. The cover member 32 preferably includes a top portion 46 and a cavity portion 48. The cavity portion 48 includes a base cavity 50, which is sized to loosely receive the base member 30.

The cover rail member 38 includes a cover flange 58, a downward extending portion 60 and a cover clip 62. The downward extending portion 60 extends from an edge of the cover flange 58 and a distal end of the downward extending portion 60 is terminated with the cover clip 62. The base clips 42 of the pair of base rail members 36 are pushed into or snapped to the cover clips 62 of the pair of cover rail members 38. A top of the cover flange 58 is preferably attached to a bottom of the top portion 46 with adhesive 44 or the like. A bottom of the cover flange 58 is preferably attached to a top of the cavity portion 48. The two cover rail members 38 are retained on substantially opposing sides of the cover member 32.

Figure 7:
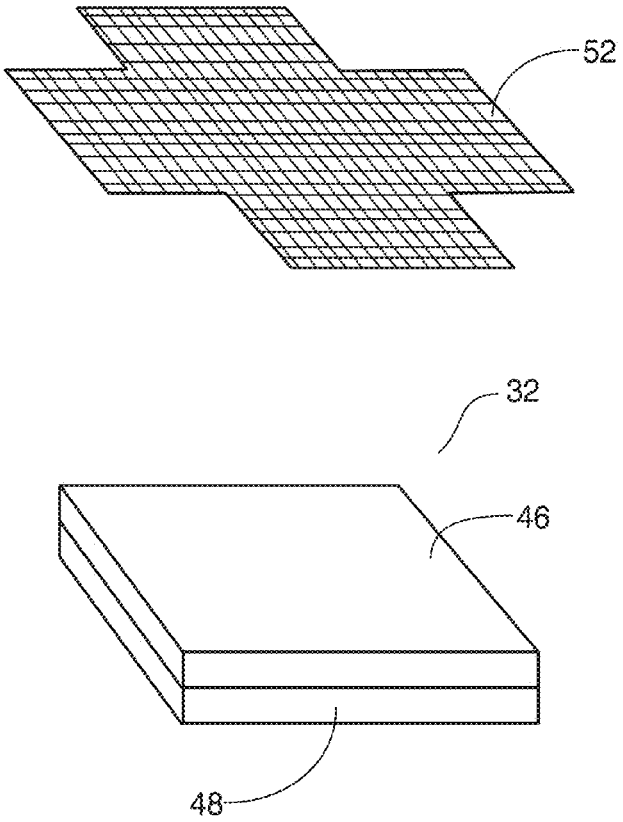
FIG. 7 is an exploded perspective view of a mesh sheet, before attachment to a cover member of a panel building system having an alternative attachment method in accordance with the present invention.

With reference to FIG. 7, it is preferable to wrap an outer perimeter of the cover member 32 with a mesh sheet 52. A coating is applied to the mesh sheet 52 to attach the mesh sheet 52 on the cover member 32. The mesh sheet 52 and coating increase the strength of the cover member 32. The mesh sheet 52 is preferably fabricated from nylon mesh. The coating is preferably acrylic, but other suitable coatings may also be used.

Figure 11:
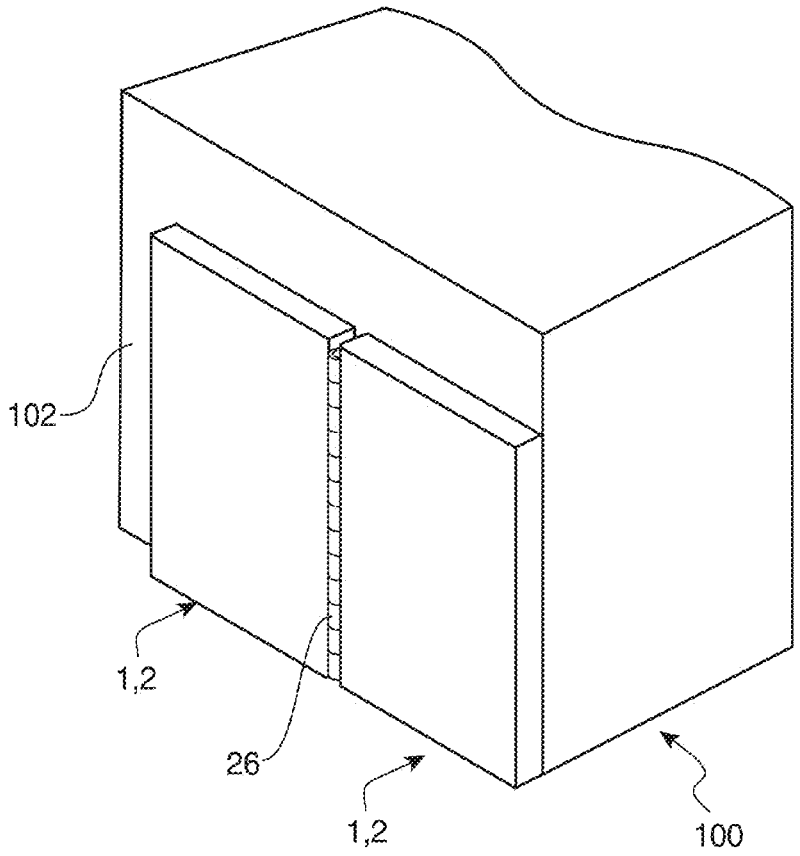
FIG. 11 is a perspective view of two adjacent panel building systems attached to a building in accordance with the present invention.

With reference to FIG. 11, a gap 104 between adjacent building panels 1, 2 is preferably filled with a backer rod 26. The backer rod 26 is packed into the gap 104 with any suitable tool. The backer rod 26 is typically fabricated from closed cell foam. The backer rod 26 is well known in the art and may be purchased from several manufacturers. The gap 104 is then caulked to seal the gap 104.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A pre-finished insulated panel building system comprising:

a panel comprising a base member and a prefabricated cover member, said base member having an outer perimeter, said prefabricated cover member having a base cavity formed in a bottom thereof, said base cavity being defined by at least three solid walls, a perimeter of said base cavity is sized to receive said outer perimeter of said base member, said outer perimeter of said base member is less than an outer perimeter of said prefabricated cover member; and a decorative coating is applied to a top and outside perimeter of said prefabricated cover member, wherein said base member is attached to one of an interior and an exterior surface of a building, said prefabricated cover member is secured to said base member.

2. The pre-finished insulated panel building system of claim 1, further comprising:

a moisture barrier sheet is attached to the building.

3. The pre-finished insulated panel building system of claim 2, further comprising:

a drainage and ventilation mat is placed over said moisture barrier sheet and attached to the building.

4. The pre-finished insulated panel building system of claim 1, further comprising:

a drainage and ventilation mat is attached directly to the building.

5. The pre-finished insulated panel building system of claim 1 wherein:

said prefabricated cover member includes a top portion and a cavity portion, a perimeter of said base cavity is formed in said cavity portion, said cavity portion is attached to a bottom of said top portion.

6. The pre-finished insulated panel building system of claim 1, further comprising:

a mesh sheet is applied to an exterior surface of said prefabricated cover member, a coating is applied to said mesh sheet to attach said mesh sheet to said prefabricated cover member.

7. The pre-finished insulated panel building system of claim 1 wherein:

said base member and said prefabricated cover member are fabricated from one of EPS foam and XPS foam.

8. The pre-finished insulated panel building system of claim 1 wherein:

said decorative coating is one an acrylic coating, a polymer modified cement coating, urethane, stucco, an epoxy and polyaspartec.

9. A pre-finished insulated panel building system comprising:

a panel comprising a base member and a prefabricated cover member, said base member having an outer perimeter, said prefabricated cover member having a base cavity formed in a bottom thereof, said base cavity being defined by four solid walls, a perimeter of said base cavity is sized to receive said outer perimeter of said base member, said outer perimeter of said base member is less than an outer perimeter of said prefabricated cover member; and a decorative coating is applied to a top and outside perimeter of said prefabricated cover member, wherein said base member is attached to one of an interior and an exterior surface of a building, said prefabricated cover member is secured to said base member.

10. The pre-finished insulated panel building system of claim 9, further comprising:

a moisture barrier sheet is attached to the building.

11. The pre-finished insulated panel building system of claim 10, further comprising:

a drainage and ventilation mat is placed over said moisture barrier sheet and attached to the building.

12. The pre-finished insulated panel building system of claim 9, further comprising:

a drainage and ventilation mat is attached directly to the building.

13. The pre-finished insulated panel building system of claim 9 wherein:

said prefabricated cover member includes a top portion and a cavity portion, a perimeter of said base cavity is formed in said cavity portion, said cavity portion is attached to a bottom of said top portion.

14. The pre-finished insulated panel building system of claim 9, further comprising:

a mesh sheet is applied to an exterior surface of said prefabricated cover member, a coating is applied to said mesh sheet to attach said mesh sheet to said prefabricated cover member.

15. The pre-finished insulated panel building system of claim 9 wherein:

said base member and said prefabricated cover member are fabricated from one of EPS foam and XPS foam.

16. The pre-finished insulated panel building system of claim 9 wherein:

said decorative coating is one an acrylic coating, a polymer modified cement coating, urethane, stucco, an epoxy and polyaspartec.

* * * * *